United States Patent [19]

Brücher et al.

[11] Patent Number: 5,035,283

[45] Date of Patent: Jul. 30, 1991

[54] NESTED-TUBE HEAT EXCHANGER

[75] Inventors: Peter Brücher; Helmut Lachmann, both of Berlin, Fed. Rep. of Germany

[73] Assignee: Borsig GmbH, Berlin, Fed. Rep. of Germany

[21] Appl. No.: 446,989

[22] Filed: Dec. 6, 1989

[30] Foreign Application Priority Data

Sep. 9, 1989 [DE] Fed. Rep. of Germany ..... 3930205

[51] Int. Cl.[5] ..... F28F 19/00; F28F 9/02

[52] U.S. Cl. ..... 165/134.1; 165/158

[58] Field of Search ..... 165/134.1

[56] References Cited

U.S. PATENT DOCUMENTS

| | | | |
|---|---|---|---|
| 3,132,691 | 5/1964 | Esleeck | 165/134.1 |
| 3,356,135 | 12/1967 | Sayre | 165/134.1 |
| 3,387,652 | 6/1968 | Drobka | 165/162 |
| 4,236,576 | 12/1980 | Deuse et al. | 165/134.1 |
| 4,245,696 | 1/1981 | Van Der Lelij | 165/134.1 |
| 4,336,770 | 6/1982 | Kaneko et al. | 165/134.1 |
| 4,431,049 | 2/1984 | Zamma et al. | 165/158 |
| 4,700,773 | 10/1987 | Kehrer | 165/134.1 |
| 4,848,449 | 7/1989 | Brucher et al. | 165/134.1 |
| 4,858,684 | 8/1989 | Brucker et al. | 165/134.1 |

FOREIGN PATENT DOCUMENTS

| | | | |
|---|---|---|---|
| 0043354 | 3/1980 | Japan | 165/134.1 |

*Primary Examiner*—John Rivell
*Assistant Examiner*—L. R. Leo
*Attorney, Agent, or Firm*—Max Fogiel

[57] ABSTRACT

A nested-tube heat exchanger with tubes (1) secured at each end in tube plates (3 & 4) for transferring heat between a hot gas that flows through the tubes (1) and a liquid or vaporous contact that flows around the pipes. The tube plates are secured to a jacket (2) that surrounds the nest of tubes. One of the tube plates has parallel cooling channels (7) in the half that faces away from the jacket with coolant flowing through the cooling channels. The tube plate has bores (15) that open into the jacket, communicate with the cooling channels, and concentrically surround the tubes. The tube plate that has the cooling channels is at the gas-intake end of the heat exchanger. The tubes in each row extend through cooling channels. The base (12) of the cooling channels on the side that is impacted by the gas is uniformly thick.

9 Claims, 6 Drawing Sheets

NESTED-TUBE HEAT EXCHANGER

Figure 1:
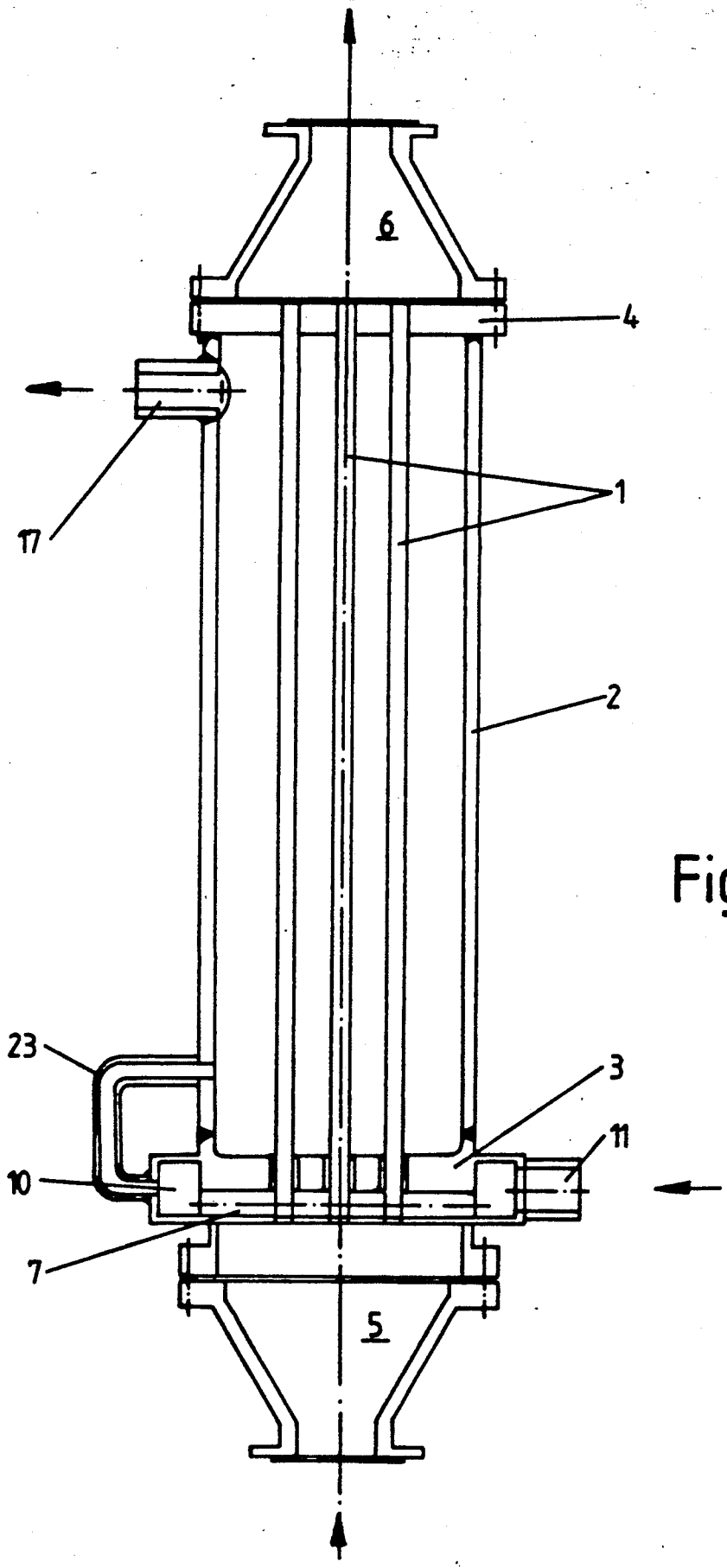

The invention concerns a nested-tube heat exchanger with tubes that are secured at each end in tube plates for transferring heat between a hot gas that flows through the pipes and a liquid or vaporous coolant that flows around the pipes, whereby the tube plates are secured to a jacket that surrounds the nest of tubes, whereby one of the tube plates has parallel cooling channels in the half that faces away from the jacket with coolant flowing through the cooling channels, and whereby the tube plate has bores that open into the jacket, communicate with the cooling channels, and concentrically surround the tubes.

Nested-tube heat exchangers of this type are used as process-gas exhaust-heat boilers for rapidly cooling reaction gases derived from cracking furnaces or chemical-plant reactors while simultaneously generating a heat-removal medium in the form of high-pressure steam. To deal with the high gas temperatures and high pressure difference between the gas and the heat-removing cooling medium, the tube plate at the gas-intake end is thinner than the tube plate at the gas-outlet end (U.S. Pat. Nos. 3,387,652 and 4,236,576). The thinner tube plate is stiffened with strips of supporting sheet metal separated from the tube plate and secured to it with anchors.

The thinner tube plate in another known nested-tube heat exchanger (U.S. Pat. No. 4,700,773) rests on welded-in supporting fingers on a supporting plate. Coolant flows through the space between the supporting plate and the tube plate, is supplied to an annular chamber, and enters the heat exchanger through annular gaps between the tubes and the supporting plate. It accordingly becomes possible to convey the coolant across the thinner tube plate. The introduction of water satisfactorily cools the tube plate and results in a high rate of flow that prevents particles from precipitating out of the coolant and onto the tube plate. This double floor has been proven very satisfactory in practice, although it is comparatively expensive to manufacture.

Providing the thicker tube plate at the gas-intake end of a nested-tube heat exchanger with cooling channels is also known, from U.S. Pat. No. 4,236,576. When the tube plate is rigid enough, accordingly, the temperature of the exiting gas can be allowed to be as high as 550° to 650° C. The cooling channels in this known tube plate are between the rows of tubes and relatively far away from one another and from the side of the tube plate that comes into contact with the gas. This system of cooling channels cools the tube plate just enough to handle the gas temperatures at the gas-outlet end of the heat exchanger.

The object of the present invention is to improve a cooled tube plate in a generic nested-tube heat exchanger to the extent that even a rapidly flowing coolant can be uniformly distributed when the walls at the gas end are thin and that gas temperatures of more than 1000° C. can be handled.

This object is attained in accordance with the invention in a generic nested-tube heat exchanger in that the tube plate that has the cooling channels is at the gas-intake end of the heat exchanger, in that the tubes in each row extend through cooling channels, and in that the base of the cooling channels on the side that is impacted by the gas is uniformly thick.

The subsidiary claims recite advantageous embodiments of the invention.

The tube plate in accordance with the invention can be thick on the whole and accordingly satisfy the demand of resisting the high pressure of the coolant. Since the pipes extend through the cooling channels and accordingly in a straight line along one row of tubes, the cooling channels can be close together, providing an extensive surface for the coolant to flow over. The uniformly thick channel base prevents accumulation of material inside the channels. Both of these characteristics lead to such effective cooling of the tube plate that gas temperatures of more than 1000° C. can be handled.

The speed at which the coolant flows through the channels can be adjusted to prevent any particles in the coolant from precipitating, eliminating the risk of overheating the tube plate. The floor at the gas-intake end of the tube plate can accordingly be thinner and can rest on the webs left between the cooling channels on a thicker part of the floor of the tube plate. This method of support is more effective than one that employs separate anchors, as will be evident in a more uniform distribution of stress. The thinner section of the floor allows cooling that is low in heat stress, and the tubes can be welded into the tube plate with a high-quality weld and without any gaps.

Figure 2:
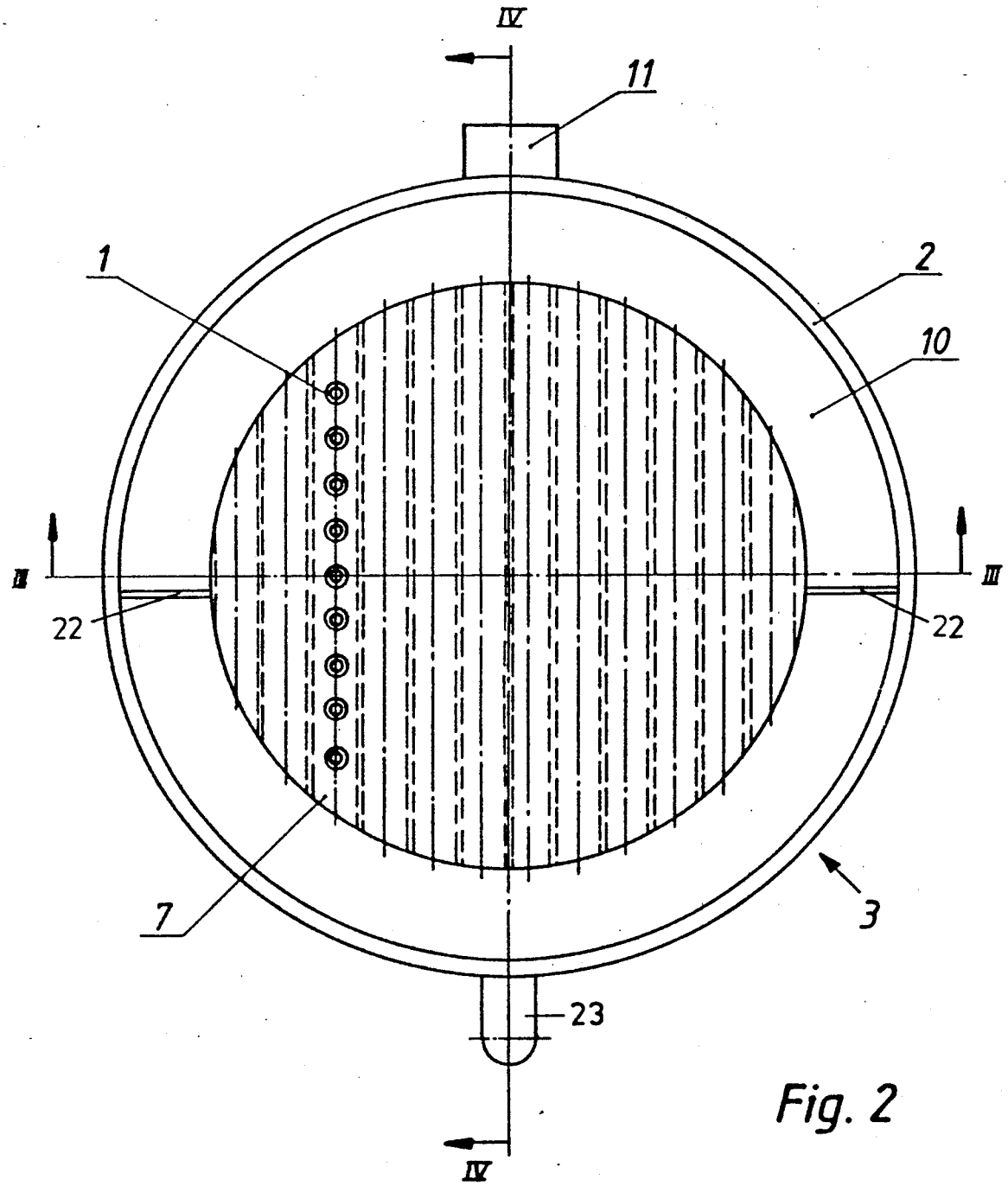
Figure 3:
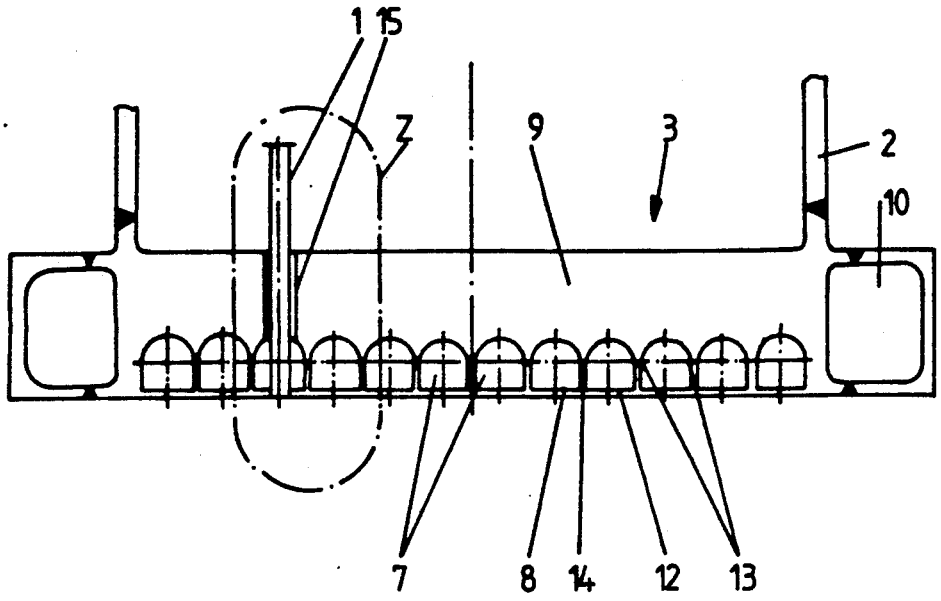
Figure 4:
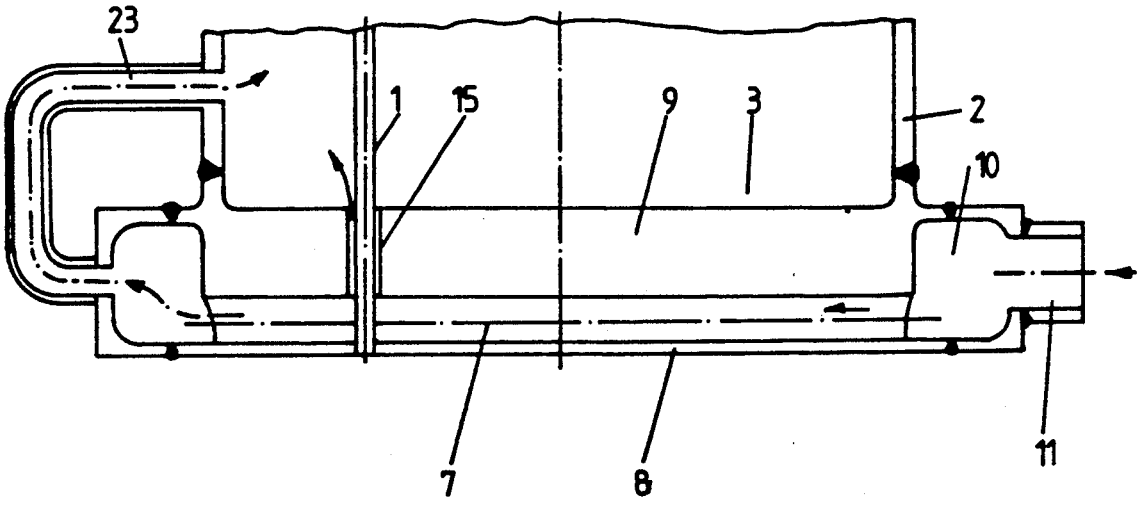
Figure 5:
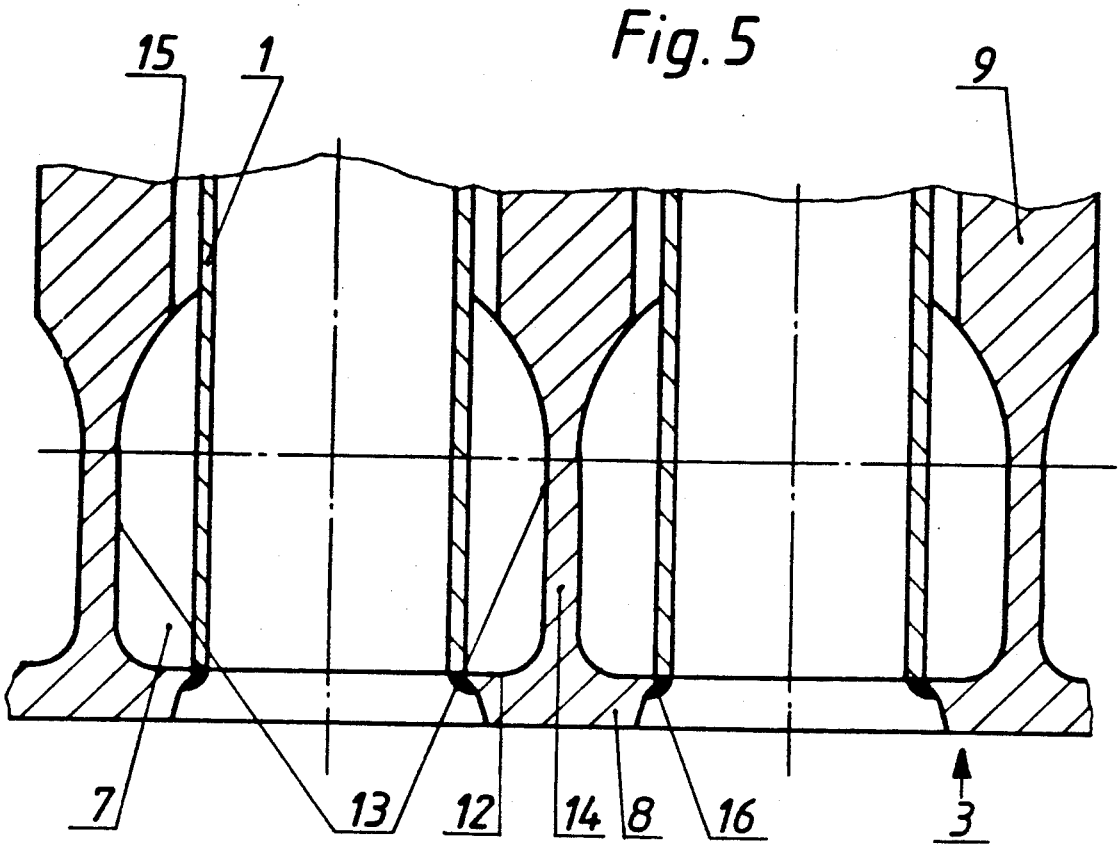
Figure 6:
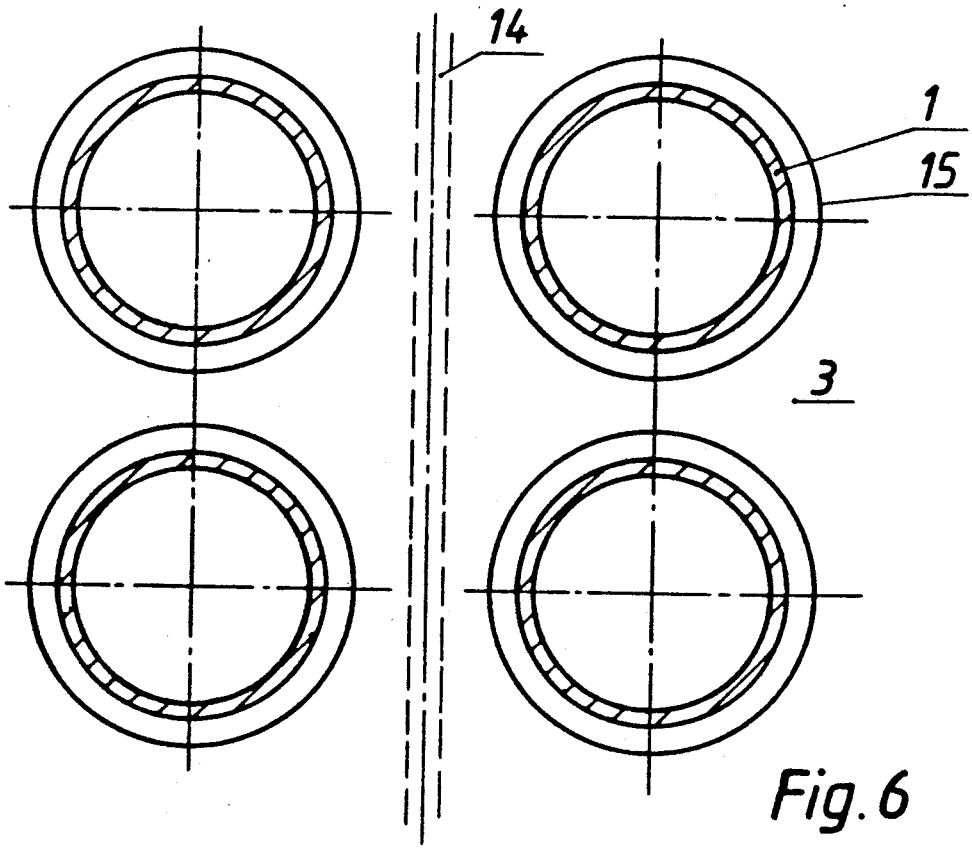
Figure 7:
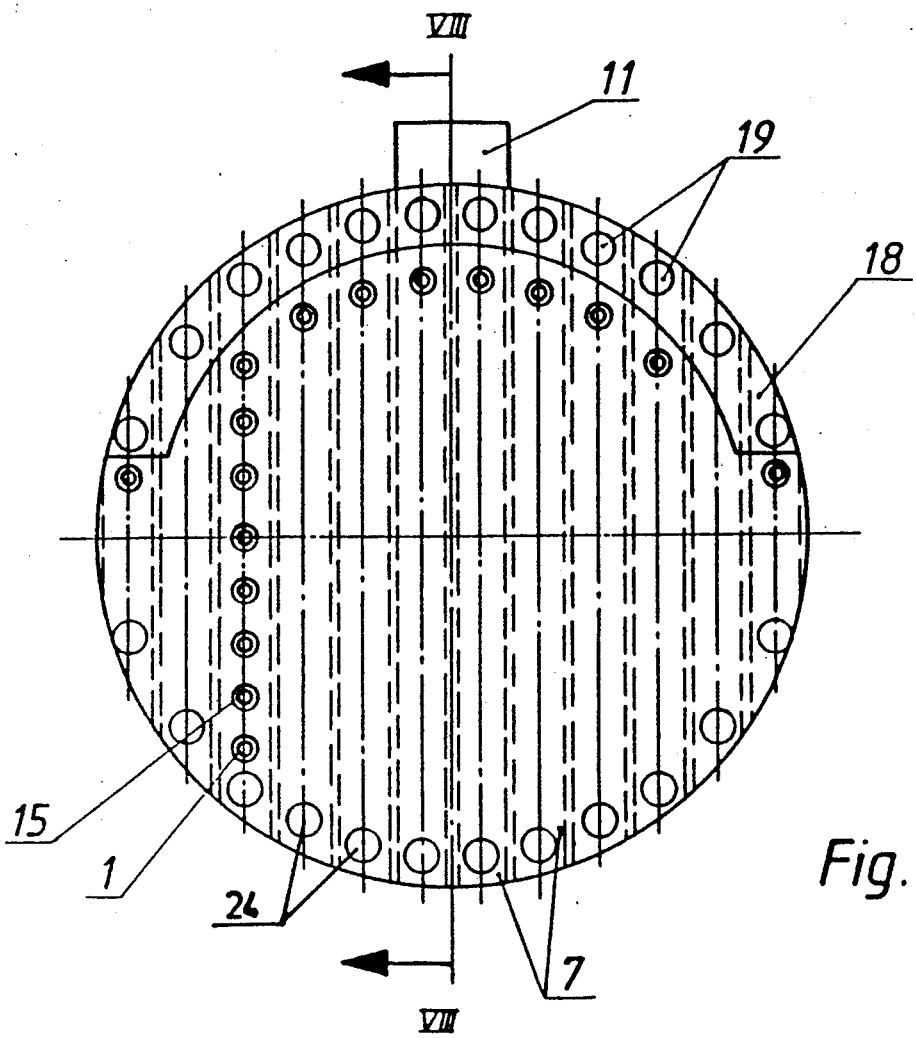
Figure 8:
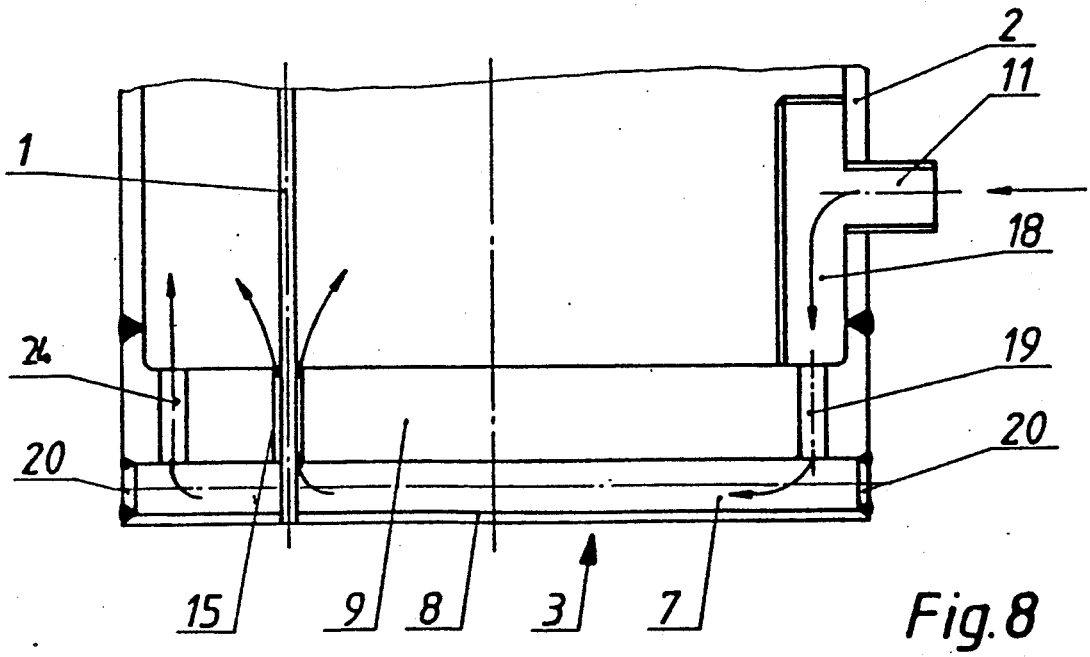
Figure 9:
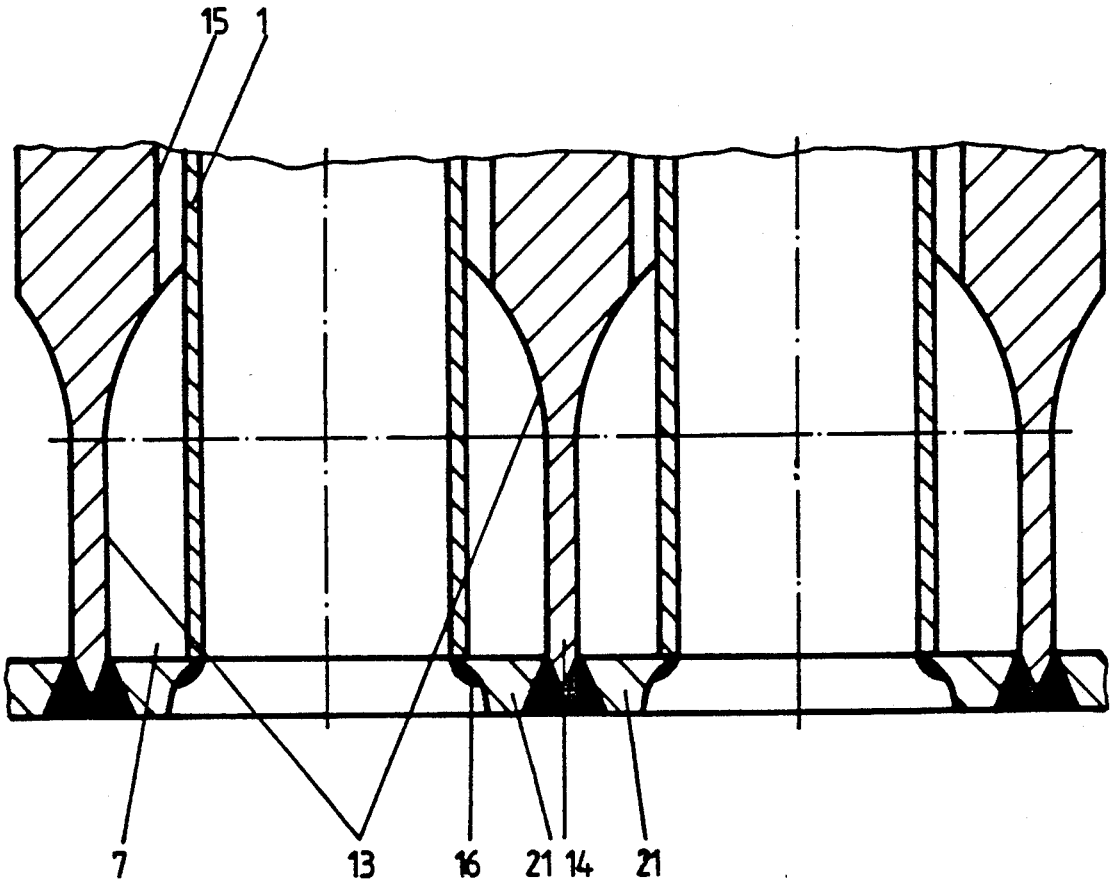

Several embodiments of the invention will now be described by way of example with reference to the drawing, wherein FIG. 1 is a longitudinal section through a heat exchanger, FIG. 2 is a top view of the tube plate on the gas-intake end, FIG. 3 is a section along the line III—III in FIG. 2, FIG. 4 is a section along the line IV—IV in FIG. 2, FIG. 5 illustrates the detail Z in FIG. 3, FIG. 6 is a top view of FIG. 5, FIG. 7 is a top view of another embodiment of the tube plate at the gas-intake end, FIG. 8 is a section along the line VIII—VIII in FIG. 7, and FIG. 9 illustrates another embodiment of the detail Z in FIG. 3.

The illustrated heat exchanger is especially intended for cooling cracked gas with highly compressed, boiling, and to some extent evaporating water. The heat exchanger consists of a nest of individual tubes 1 that have the gas to be cooled flowing through them and are surrounded by a jacket 2. For simplicity's sake only individual tubes 1 are illustrated. The tubes are secured in two tube plates 3 and 4 that communicate with a gas intake 5 and with a gas outlet 6 and are welded into a jacket 2.

The tube plate 3 at the gas-intake end is provided with parallel cooling channels 7. The channels are closer together at the gas end of tube plate 3 along the axis of the plate than at the inner surface of jacket 2. The section 8 of floor at the gas end is accordingly thinner and the section 9 of floor nearer jacket 2 is thicker.

The cooling channels 7 illustrated in FIGS. 1 are open at each end and open into a chamber 10 that surrounds tube plate 3 like a ring. The intake end of chamber 10 is provided with one or more connectors 11 that the highly compressed coolant is supplied through.

Cooling channels 7 can be in the form of cylindrical bores extending through tube plate 3 parallel to its surface. Their initially circular cross-section, however, is machined to expand it into the illustrated shape of a tunnel, characterized by a vaulted sealing and a flat base 12 that parallels the upper surface of tube plate 3. This is an especially easy way of attaining a thin floor of constant thickness. The walls 13 of tunnel-shaped cooling channels 7 are also flat and extend preferably perpendicular to base 12. Walls 13 constitute narrow webs 14, on which the thinner section 8 of the floor rests on the thicker section 9 over an extensive supporting area.

Tube plate 3 has bores 15 inside thicker section 9 that open toward the inside of jacket 2 and into cooling channels 7 perpendicular to their length. Nest tubes 1 extend loosely through bores 15, leaving an annular gap. The tubes 1 in one row extend through one cooling channel 7 and are welded tight into the thinner section 8 of tube plate 3 by a continuous seam 16. The resulting cooling channels 7 are one to two times as wide as the diameter of tubes 1.

The coolant is supplied to the intake side of chamber 10 through supply connectors 11 and arrives in cooling channels 7, some of it traveling through the annular gaps between tubes 1 and bores 15 and into the inside of the heat exchanger, demarcated by jacket 2. This portion of the coolant ascends along the outside of the tubes 1 in jacket 2 and emerges in the form of highly compressed steam from an outlet 17 welded into jacket 2.

The coolant that does not enter the heat exchanger through the annular gaps exits from cooling channels 7 at the other end and arrives at the outlet end of chamber 10. The outlet end of chamber 10 is separated from the intake end by two partitions 22 positioned perpendicular to the longitudinal axis of cooling channels 7 and extending over the total cross-section of the chamber. One end of each cooling channel 7 accordingly always communicates with the intake end and the other end with the outlet end. Connected to the outlet end of chamber 10 is an elbow 23 that opens into the heat exchanger. The rest of the coolant enters the heat exchanger through elbow 23 and is also converted into highly compressed steam. This transfer of part of the coolant sufficiently accelerates the flow at the outlet end of cooling channels 7 as well to prevent solid particles from precipitating out of the coolant and onto the base 12 of cooling channels 7. These particles are, rather, rinsed out through cooling channels 7.

To ensure uniform flow through all cooling channels 7, the impedance of the outer and shorter cooling channels 7 can be adjusted to match that of the more central and longer channels by for example making the outer channels narrower or by providing them with constrictions.

FIGS. 7 and 8 illustrate an inner coolant-intake chamber 18 extending halfway around the heat exchanger. The wall of intake chamber 18 is connected to the inner surface of jacket 2 and at the edge to tube plate 3. The cooling channels 7 in this embodiment are closed off at each end by a cover 20. At each end of a cooling channel 7 is a bore 19 or 24 that extends axially through the thicker section 9 of the floor of tube plate 3. Bore 19 extends out of intake chamber 18 and supplies coolant to cooling channels 7. Bore 24 opens into the heat exchanger and removes the coolant that does not emerge through the annular gaps between tubes 1 and bores 15.

Cooling channels 7 can also, illustrated in FIG. 9 be machined out of the edges of tube plate 3. Such channels can have either a vaulted or a flat ceiling. These recesses are covered up with strips 21 of sheet metal welded to the webs 14 between cooling channels 7. This embodiment necessitates more welds than does the one illustrated in FIGS. 1 through 8, which, although it sometimes facilitates manufacture, can lead to additional stress and weaken the structure.

We claim:

1. A nested-tube heat exchanger comprising: tube plates; a nest of tubes secured at each end in said tube plates for transferring heat between a hot gas flowing through said tubes and a liquid or vaporous coolant flowing around said tubes; a jacket surrounding said nest of tubes and secured to said tube plates; one tube plate having parallel cooling channels in a part of said tube plate facing away from said jacket, said cooling channels conducting coolant therethrough; said tube plate having bores opening into said jacket and communicating with said cooling channels, said bores being arranged concentrically around said tubes; a gas-intake end, said tube plate with said cooling channels being at said gas-intake end; said tubes extending through said cooling channels; said cooling channels having a base of uniform thickness impinged by said gas; a coolant-intake chamber extending halfway around said heat exchanger and connected to an inner surface of said jacket as well as to an edge of said tube plate; each cooling channel being closed at each end and communicating with said coolant-intake chamber through an axial bore.

2. A nested-tube heat exchanger as defined in claim 1, wherein an additional bore extends axially between said cooling channels and interior of said heat exchanger at an end of said channels facing away from said axial bore.

3. A nested-tube heat exchanger comprising: tube plates; a nest of tubes secured at each end in said tube plates for transferring heat between a hot gas flowing through said tubes and a liquid or vaporous coolant flowing around said tubes; a jacket surrounding said nest of tubes and secured to said tube plates; one tube plate having spaced apart parallel cooling channels in a part of said tube plate facing away from said jacket, said cooling channels conducting coolant therethrough; said tube plate having bores opening into said jacket and communicating with said cooling channels, said bores being arranged concentrically around said tubes; a gas-intake end, said tube plate with said cooling channels being at said gas-intake end; said cooling channels having a base of uniform thickness impinged by said gas; said cooling channels distributing said coolant in a flow having a predetermined flow velocity at each position of said tube plate; said cooling channels being penetrated by said tubes for reducing said space between said cooling channels and increasing flow surface of said coolant.

4. A nested-tube heat exchanger as defined in claim 3, wherein said cooling channels are tunnel-shaped, said cooling channels having a vaulted ceiling, a flat base, and flat walls extending perpendicular to said flat base.

5. A nested-tube heat exchanger as defined in claim 3, including an annular chamber surrounding said tube plate, said cooling channels being open at each end and opening into said annular chamber.

6. A nestd-tube heat exchanger as defined in claim 5, including two partitions separating said annular chamber perpendicular to a longitudinal axis of said cooling channels into an intake end and an outlet end; and an elbow secured to said outlet end of said annular chamber and to said jacket.

7. A nested-tube heat exchanger as defined in claim 3, wherein said cooling channels ccomprise outer cooling channels and inner cooling channels, said outer cooling channels having a higher impedance to flow than said inner coolng channels.

8. A nested-tubee heat exchanger as defined in claim 3, wherein said coolng channels are machined into a single-piece plate.

9. A nested-tube heat exchanger as defined in claim 3, wherein said cooling channels are recesses in an edge of said tube plate; and sheet metal strips covering said recesses.

* * * * *